US006922180B2

(12) United States Patent
Iwami et al.

(10) Patent No.: US 6,922,180 B2
(45) Date of Patent: Jul. 26, 2005

(54) DRIVING APPARATUS OF DISPLAY PANEL

(75) Inventors: Takashi Iwami, Yamanashi (JP); Nozomu Kikuchi, Yamanashi (JP)

(73) Assignees: Pioneer Corporation, Tokyo (JP); Pioneer Display Products Corporation, Shizuoka (JP)

( * ) Notice: Subject to any disclaimer, the term of this patent is extended or adjusted under 35 U.S.C. 154(b) by 369 days.

(21) Appl. No.: 10/154,926

(22) Filed: May 28, 2002

(65) Prior Publication Data

US 2002/0190928 A1 Dec. 19, 2002

(30) Foreign Application Priority Data

Jun. 14, 2001 (JP) ..... 2001-179900

(51) Int. Cl.[7] ..... G09G 3/34
(52) U.S. Cl. ..... 345/60; 345/84; 345/204
(58) Field of Search ..... 345/60, 61, 62, 345/63, 67, 68, 80, 84, 87, 204, 82, 83

(56) References Cited

U.S. PATENT DOCUMENTS 6,195,072 B1 * 2/2001 Iwami et al. ..... 345/67
6,567,059 B1 * 5/2003 Ide et al. ..... 345/60

* cited by examiner

*Primary Examiner*—Henry N. Tran
*Assistant Examiner*—Jean Lesperance
(74) *Attorney, Agent, or Firm*—Morgan, Lewis & Bockius LLP

(57) ABSTRACT

A PDP driving apparatus having a resonance driver of a PDP electrode for shortening a time required to display an image since the power-up. A power collecting capacitor included in each electrode resonance driver is charged rapidly to a predetermined potential upon power-up of the PDP driving apparatus by allowing each electrode resonance driver to drive electrodes by means of excitation. Also, while the power collecting capacitor included in the row electrode pair driver is charged, charge driving pulses in-phase and of the same polarity are applied respectively to corresponding two electrodes to drive these electrodes by means of excitation.

5 Claims, 6 Drawing Sheets

DRIVING APPARATUS OF DISPLAY PANEL

BACKGROUND OF THE INVENTION

1. Field of the Invention

The present invention relates to a driving apparatus of a display panel having a capacitive light emitting display load, such as a plasma display panel (hereinafter, abbreviated to PDP) of the matrix display type and an EL (electroluminescence) display apparatus.

2. Description of the Related Art

PDPs have been studied extensively as a thin flat display apparatus, and a PDP of the matrix display type is known as one example.

FIG. 1 is a view schematically showing an arrangement of a PDP driving apparatus including the aforementioned PDP.

Referring to FIG. 1, a PDP 1 is provided with row electrodes $Y_1$ through $Y_n$ and row electrodes $X_1$ through $X_n$, wherein pairs of an electrode X and an electrode Y form row electrode pairs corresponding to respective rows (the first row through the n'th row) in one screen. Further, the PDP 1 is provided with column electrodes $D_1$ through $D_m$, intersecting at right angles with the row electrode pairs with unillustrated dielectric layer and discharge space in between, that form column electrodes corresponding to respective columns (the first column through the m'th column) in one screen. Herein, a discharge cell corresponding to one pixel is formed at each intersection portion of each row electrode pair and each column electrode.

An address driver 2 converts pixel data for each pixel based on a video signal to a pixel data pulse having a voltage value corresponding to its logical level, and applies one row of pixel data pulses to the column electrodes $D_1$ through $D_m$ row by row.

An X row electrode driver 3 generates a reset pulse for initializing a quantity of residual wall charges in each discharge cell and a sustaining discharge pulse for sustaining a discharge-to-emit light condition of a light emitting discharge cell as will be described below, and applies these pulses to the row electrodes $X_1$ through $X_n$.

Like the X row electrode driver 3, a Y row electrode driver 4 generates a reset pulse for initializing a quantity of residual wall charges in each discharge cell and a sustaining discharge pulse for sustaining a discharge-to-emit light condition of a light emitting discharge cell, and applies these pulses to the row electrodes $Y_1$ through $Y_n$. Further, the Y row electrode driver 4 generates a priming pulse (PP) for allowing charged particles generated within the discharge cell to be formed again and a scanning pulse (SP) for allowing a quantity of charges corresponding to the pixel data pulse to be generated in each discharge cell to set the light emitting discharge cell or a non-luminous discharge cell, and applies these pulses to the row electrodes $Y_1$ through $Y_n$.

FIG. 2 shows a concrete arrangement of the X row electrode driver 3, the Y row electrode driver 4, and the address driver 2, wherein the drivers are shown as to an electrode $X_j$, an electrode $Y_j$, and an electrode $D_i$ for one pixel. The electrode $X_j$ is the electrode in the j'th row among the electrodes $X_1$ through $X_n$, and the electrode $Y_j$ is the electrode in the j'th row among the electrodes $Y_1$ through $Y_n$. A space between the electrode $X_j$ and the electrode $Y_j$ functions as a capacitor C0. Also, the electrode $D_i$ is the electrode in the i'th column among the electrodes $D_1$ through $D_m$.

The X row electrode driver 3 is provided with two power sources B1 and B2. The power source B1 outputs a voltage $V_{s1}$ (for example, 170 V), and the power source B2 outputs a voltage $V_{r1}$ (for example, 190 V). The positive terminal of the power source B1 is connected to a connection line 11 to the electrode $X_j$ through a switching element S3, and the negative terminal is grounded. Connected somewhere between the connection line 11 and the ground are, in addition to a switching element S4, a series circuit composed of a switching element S1, a diode D1, and a coil L1, and another series circuit composed of a coil L2, a diode D2, and a switching element S2 through a common capacitor C1 at the ground side. The diode D1 is connected so that its anode is at the capacitor C1 side and the diode D2 is connected so that its cathode is at the capacitor C1 side. Also, the positive terminal of the power source B2 is connected to the connection line 11 through a switching element S8 and a resistor R1, and the negative terminal of the power source B2 is grounded.

The Y row electrode driver 4 is provided with four power sources B3 through B6. The power source B3 outputs a voltage $V_{s1}$ (for example, 170 V), the power source B4 outputs a voltage $-V_{r1}$ (for example, −190 V), the power source B5 outputs a voltage $-V_{off}$ (for example, −10 to −20 V), and the power source B6 outputs a voltage $V_h$ (for example, 160 V, $V_h > V_{off}$). The positive terminal of the power source B3 is connected to a connection line 12 to a switching element S15 through a switching element S13, and the negative terminal is grounded. A switching element S14 is connected between the connection line 12 and the ground. Also connected between the connection line 12 and the ground are, a series circuit composed of a switching element S11, a diode D3, and a coil L3, and another series circuit composed of a coil L4, a diode D4 and a switching element S12 through a common capacitor C2 at the ground side. The diode D3 is connected in a direction that its anode is on the capacitor C2 side and the diode D4 is connected in a direction that its cathode is on the capacitor C2 side.

The connection line 12 is connected to a connection line 13 to the negative terminal of the power source B6 through the switching element S15. The positive terminal of the power source B4 is grounded, and the negative terminal is connected to the connection line 13 through a switching element S16 and a resistor R2. The negative terminal of the power source B5 is connected to the connection line 13 through a switching element S17, and the positive terminal is grounded.

Also, the connection line 13 is connected to a connection line 14 to the electrode $Y_j$ through a switching element S22. The positive terminal of the power source B6 is connected to the connection line 14 through a switching element S21. A diode D6 is connected somewhere between the connection lines 13 and 14, and a diode D5 is connected somewhere between the positive terminal of the power source B6 and the connection line 14 in parallel. The diode D5 is connected in a direction that its anode is on the connection line 14 side, and the diode D6 is connected in a direction that its cathode is on the connection line 14 side.

The address driver 2 is provided with a power source B7 that outputs a voltage $V_d$ (for example, 60 V). The positive terminal of the power source B7 is connected to the electrode $D_i$ through a switching element S33, a connection line 15, and a switching element S35, and the negative terminal is grounded. A switching element S34 is connected between the connection line 15 and the ground. Also connected between the connection line 15 and the groundare, a series circuit composed of a switching element S31, a diode D7 and a coil L5, and another series circuit composed of a coil L6, a diode D8, and a switching element S32 through a common capacitor C3 at the ground side. The diode D7 is connected in a direction that its anode is on the capacitor C3 side and the diode D8 is connected in a direction that its cathode is on the capacitor C3 side.

Also, the electrode $D_i$ is grounded through a switching element S36. Incidentally, the switching elements S35 and S36 operate alternately, and control generation of an address data pulse to be supplied to the capacitor C0 in the discharge cell unit.

In the circuitry of FIG. 2, the capacitors C1, C2, and C3 (hereinafter, referred to as the power collecting capacitors) included in the X row electrode driver 3, the Y row electrode driver 4, and the address driver 2, respectively, are connected to power sources B8, B9, and B10 through resistors R10, R20, and R30, respectively, only for a predetermined period upon power-up of the PDP apparatus. These power sources charge their respective power collecting capacitors to midpoint potentials of their respective resonance voltages. The potentials of the power sources B8 and B9 are half the aforementioned $V_{s1}$, that is, $V_{s1}/2$, and the potential of the power source B10 is half the aforementioned $V_d$, that is, $V_d/2$.

The ON/OFF operations of the switching elements S1 through S4, S8, S11 through S17, S21 and S22, and S31 through S36 included in theses drivers are controlled by an unillustrated control circuit. Incidentally, an arrow at each switching element in FIG. 2 indicates a control signal terminal from the control circuit.

Herein, in the Y row electrode driver 4, the power source B3, the switching elements S11 through S15, the coils L3 and L4, the diodes D3 and D4, and the capacitor C2 form a sustaining driver (sustaining discharge driving); the power source B4, the resistor R2, and the switching element S16 form a reset driver; and the rest of the power sources B5 and B6, the switching elements S17, S21, and S22, and the diodes D5 and D6 form a scanning driver (scanning driving).

Next, the following description will describe an operation of the above-arranged PDP driving circuit with reference to the timing chart of FIG. 3. The operation of the PDP driving apparatus is mainly composed of a reset period, an address period, and a sustain period.

Initially, when the PDP driving circuit enters the reset period, the switching element S8 in the X row electrode driver 3 is switched ON, and both the switching elements S16 and S22 in the Y row electrode driver 4 are switched ON. At this point, all the other switching elements stay OFF.

When the switching element S8 is switched ON, a current starts to flow from the positive terminal of the power source B2 to the electrode $X_j$ through the switching element S8 and the resistor R1. Also, when the switching elements S16 and S22 are switched ON, a current flows into the negative terminal of the power source B4 from the electrode $Y_j$ through the switching element S22, the resistor R2, and the switching element S16. A potential of the electrode $X_j$ increases gradually because of a time constant of the capacitor C0 and the resistor R1 and becomes a reset pulse $PR_x$, while the potential of the electrode $Y_j$ decreases gradually because of a time constant of the capacitor C0 and the resistor R2 and becomes a reset pulse $PR_y$. A peak-to-peak value of the reset pulse $PR_x$ becomes the voltage $V_{r1}$ of the power source B2 in the end, while the peak-to-peak value of the reset pulse $PR_y$ becomes the voltage $-V_{r1}$ of the power source B4. The reset pulse $PR_x$ is applied to all the electrodes $X_1$ through $X_n$ concurrently, and likewise, the reset pulse $PR_y$ is generated for each of the electrodes $Y_1$ through $Y_n$ and applied to all the electrodes $Y_1$ through $Y_n$ concurrently.

By applying these reset pulses $RP_x$ and $RP_y$ concurrently, all the discharge cells in the PDP 1 are excited to discharge, whereby charged particles are generated. When the discharge ends, wall charges of a predetermined quantity are formed uniformly on the dielectric layers in all the discharge cells.

The switching elements S8, S16, and S22 are switched OFF after the reset pulses $PR_x$ and $PR_y$ reach the saturation level and before the reset period ends. At this point, the switching elements S4, S14, and S15 are switched ON, and both the electrodes $X_j$ and $Y_j$ are grounded, whereupon the reset pulses $PR_x$ and $PR_y$ are lost. The PDP driving circuit operates as has been described during the reset period.

Subsequently, when the address period starts, the switching elements S14 and S15 are switched OFF and the switching element S17 is switched ON, and at the same time, the switching element S22 is switched ON. When the switching elements S17 and S22 are switched ON, the negative potential $-V_{off}$ at the negative terminal of the power source B5 is applied to the electrode $Y_j$ through the switching element S17 and the switching element S22.

During the address period, the address driver 2 converts the pixel data for each pixel based on a video signal to pixel data pulses $DP_1$ through $DP_n$ each having a voltage value corresponding to their respective logical levels, and successively applies one row of the data pulses to the column electrodes $D_1$ through $D_m$. For example, as shown in FIG. 3, the pixel data pulses $DP_j$ and $DP_{j+1}$ are applied to the electrodes $Y_j$ and $Y_{j+1}$.

On the other hand, during the address period, the Y row electrode driver 4 successively applies the priming pulse (PP) of a positive voltage to the row electrodes $Y_1$ through $Y_n$. Further, the Y row electrode driver 4 successively applies the scanning pulse (SP) of a negative voltage to the row electrodes $Y_1$ through $Y_n$ immediately after each is applied with the priming pulse (PP) and in synchronism with the timing of each pulse in a group of the pixel data pulses $DP_1$ through $DP_n$.

The following description will describe the above operation in terms of the Y row electrode driver 4. That is, the switching element S21 is switched ON and the switching element S22 is switched OFF when the priming pulse (PP) is generated. On the other hand, the switching element S17 stays ON. Consequently, the power source B6 and the power source B5 are connected in series through the switching element S17, whereby $(V_h-V_{off})$ (for example, 160 V−20 V=140 V) is given as the potential at the positive terminal of the power source B6. The resulting positive potential is applied to the electrode $Y_j$ through the switching element S21 as the priming pulse (PP).

After the priming pulse (PP) is applied, the switching pulse S21 is switched OFF in synchronism with the application of the pixel data pulse $DP_j$ from the address driver 2, whereupon the switching element S22 is switched ON. Consequently, the negative potential $-V_{off}$ at the negative terminal of the power source B5 is applied to the electrode $Y_j$ through the switching element S17 and then the switching element S22 as the scanning pulse (SP). Subsequently, the switching element S21 is switched ON at the same time when the application of the pixel data pulse $DP_j$ from the address driver 2 is stopped, whereupon the switching element S22 is switched OFF. As a consequence, the potential $(V_h-V_{off})$ at the positive terminal of the power source B6 is applied to the electrode $Y_j$ through the switching element S21. Then, as shown in FIG. 3, the priming pulse (PP) is applied to the electrode $Y_{j+1}$ in the (j+1)'th row in the same manner as the electrode $Y_j$, and the scanning pulse (SP) is applied in synchronism with the application of the pixel data pulse $DP_{j+1}$ from the address driver 2.

Of all the discharge cells belonging to the row electrodes to which the scanning pulse (SP) is applied, those to which the pixel data pulse DP of a positive voltage is applied concurrently will start to discharge, so that these discharge cells lose most of the wall charges. On the other hand, the discharge cells to which the scanning pulse (SP) is applied but the pixel data pulse of a positive voltage is unapplied will not start to discharge, so that these discharge cells hold the residual wall charges. Herein, the discharge cells holding the residual wall charges become the light emitting discharge cells, and the discharge cells having lost the wall charges become the non-luminous discharge cells. The PDP driving circuit operates as has been described during the address period.

Next, the following description will describe an operation during the sustain period.

In the Y row electrode driver 4, the switching elements S17 and S21 are switched OFF, and in turn, the switching elements S14 and S15 are switched ON when the address period shifts to the sustain period.

On the other hand, in the X row electrode driver 3, the switching element S4 stays ON since the preceding address period, and the potential of the electrode $X_j$ is the ground potential at almost 0 V. Then, the switching element S4 is switched OFF, and the switching element S1 is switched ON, whereupon a current reaches the electrode $X_j$ through the coil L1, the diode D1, and the switching element S1 due to the charges accumulated in the capacitor C1, and the current flows into the capacitor C0, whereby the capacitor C0 is charged. At this point, as shown in FIG. 3, the potential of the electrode $X_j$ increases gradually because of a time constant of the coil L1 and the capacitor C0.

Then, the switching element S1 is switched OFF, and the switching element S3 is switched ON. Consequently, the potential $V_{s1}$ at the positive terminal of the power source B1 is applied to the electrode $X_j$. Subsequently, the switching element S3 is switched OFF, and the switching element S2 is switched ON, whereupon a current flows into the capacitor C1 from the electrode $X_j$ through the coil L2, the diode D2, and the switching element S2 due to the charges accumulated in the capacitor C0.

At this point, as shown in FIG. 3, the potential of the electrode $X_j$ decreases gradually because of a time constant of the coil L2 and the capacitor C1. When the potential of the electrode $X_j$ decreases to almost 0 V, the switching element S2 is switched OFF, and the switching element S4 is switched ON, whereupon the capacitor C0 is grounded.

According to a series of these operations, the X row electrode driver 3 applies a sustaining discharge pulse $IP_x$ of a positive voltage as shown in FIG. 3 to the electrode $X_j$.

In the Y row electrode driver 4, when the switching element S4 is switched ON, at which the sustaining discharge pulse $IP_x$ is lost, the switching element S11 is switched ON and the switching element S14 is switched OFF concurrently. The potential of the electrode $Y_j$ is the ground potential at almost 0 V while the switching element S14 stays ON. However, when the switching element S14 is switched OFF and the switching element S11 is switched ON, a current reaches the electrode $Y_j$ through the coil L3, the diode D3, the switching element S11, the switching element S15, and the diode D6 due to the charges accumulated in the capacitor C2, and the current flows into the capacitor C0, whereby the capacitor C0 is charged. At this point, as shown in FIG. 3, the potential of the electrode $Y_j$ increases gradually because of a time constant of the coil L3 and the capacitor C0.

Then, the switching element S11 is switched OFF and the switching element S13 is switched ON. Consequently, the potential $V_{s1}$ at the positive terminal of the power source B3 is applied to the electrode $Y_j$ through the switching element S13, the switching element S15, and the diode D6. Subsequently, the switching element S13 is switched OFF and the switching element S12 is switched ON, and further, the switching element S22 is switched ON. Consequently, a current flows into the capacitor C2 from the electrode $Y_j$ through the switching element S22, the switching element S15, the coil L4, the diode D4, and the switching element S12 due to the charges accumulated in the capacitor C0. At this point, as shown in FIG. 3, the potential of the electrode $Y_j$ decreases gradually because of a time constant of the coil L4 and the capacitor C2. When the potential of the electrode $Y_j$ decreases to almost 0 V, the switching elements S12 and S22 are switched OFF and the switching element S14 is switched ON.

According to the above operation, the Y row electrode driver 4 applies a sustaining discharge pulse $IP_y$ of a positive voltage as shown in FIG. 3 to the electrode $Y_j$.

As has been described, during the sustain period, the sustaining discharge pulse $IP_x$ and the sustaining discharge pulse $IP_y$ are generated alternately, and respectively applied to the electrodes $X_1$ through $X_n$ and the electrodes $Y_1$ through $Y_n$ alternately. Hence, the light emitting discharge cells holding the residual wall charges repeat the discharge to emit light with the application of the sustaining discharge pulse voltage, thereby sustaining the light emitting condition.

The above description described an operation of the so-called normal display driving sequence composed of the reset period, the address period, and the sustain period in the PDP driving apparatus/driving circuit shown in FIGS. 1 and 2.

Incidentally, according to the conventional PDP driving apparatus, it is necessary to charge the power collecting capacitors (C1 through C3) in their respective resonance drivers shown in FIG. 2 to predetermined potentials upon power-up of the apparatus before the display driving sequence starts. In other words, if the aforementioned display driving sequence is started while the potentials of these capacitors are 0, the operation may possibly cause a problem because of a potential difference within the resonance circuits. Hence, it is necessary to charge these capacitors to around the midpoint potentials of the resonance voltages in their respective resonance driver circuits after the PDP driving apparatus is turned ON and before the aforementioned display driving sequence is started.

For this reason, according to the conventional apparatus, as shown in FIG. 2, all the resonance drivers are provided with the power sources B8 through B10, respectively, for charging the power collecting capacitors, and the respective capacitors C1 through C3 are charged directly to the midpoint potentials ($V_{s1}/2$ or $V_d/2$) of the resonance voltages from these power sources through the resistors R10, R20, and R30, respectively.

According to this method, however, the capacitors need to be charged through a series resistor having a relatively large resistance value to control a rush current upon power-up of the apparatus. Hence, there is a problem that the charging of these capacitors is time-consuming, and it takes a time until an image is displayed by shifting to the normal display driving sequence since the power-up of the apparatus.

SUMMARY OF THE INVENTION

The present invention provides a driving apparatus of a light emitting display panel having a capacitive load and capable of charging power collecting capacitors included in respective resonance driver circuits to predetermined potentials safely at high speeds by solving the problems described above.

The present invention provides a driving apparatus for driving a display panel, having a plurality of row electrode pairs and a plurality of column electrodes aligned to intersect with the row electrode pairs in forming a light emitting display cell at each intersection portion, to emit light by including a plurality of driving circuits for selectively supplying light-emitting-display driving pulses to the row electrode pairs and the column electrodes through an output terminal, wherein: each of the driving circuits includes a switch circuit for forming a forward/reverse current path alternatively between the output terminal and a power collecting capacitive element through an inductance element, and has a switching resonance charge/discharge circuit for performing generation of the driving pulses; and the switch circuit performs a switching operation not only during a light emitting display operation, but also upon power-up.

Also, according to the present invention, of the driving circuits, as to a pair of first driving circuits connected to each of the row electrode pairs: the switch circuit in each of the first driving circuits performs the switching operation in synchronism with each other; and the power collecting capacitive element in each of the first driving circuits is charged to a midpoint potential of a resonance voltage.

Further, according to the present invention, of the driving circuits, as to a second driving circuit connected to the column electrodes: the switch circuit in the second driving circuit performs the switching operation alternately with the switching operation by the first driving circuits; and the power collecting capacitive element in the second driving circuit is charged to the midpoint potential of the resonance voltage.

DETAILED DESCRIPTION OF THE PREFERRED EMBODIMENT

The following description will describe in detail one embodiment of the present invention with reference to drawings.

Figure 4:
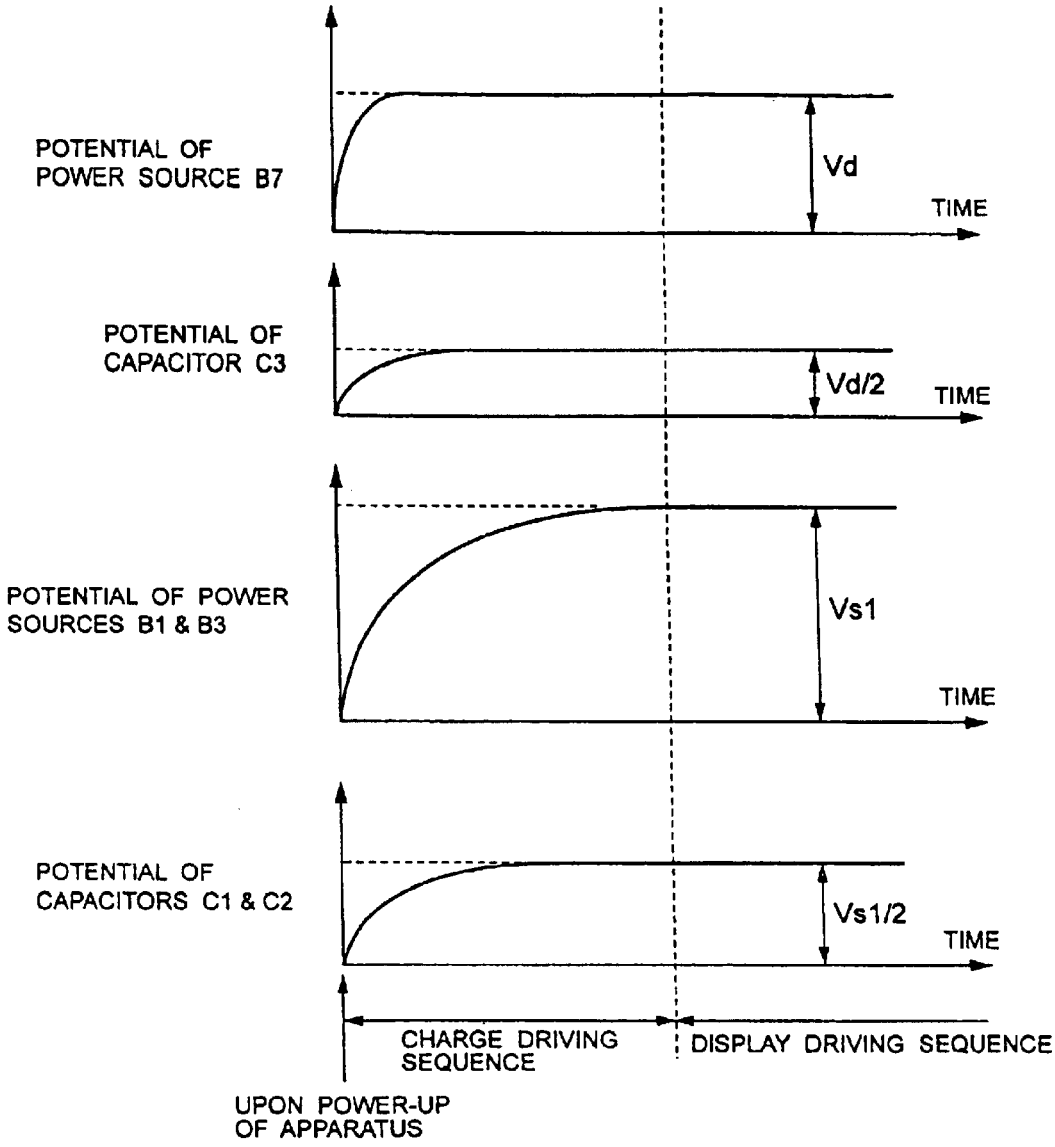
FIG. 4 is a time chart showing a relation between a charge driving sequence and a display driving sequence of the present invention.

A PDP driving apparatus of the present invention performs the so-called charge driving sequence to charge each power collecting capacitor included in their respective driver circuits to a predetermined potential for each of the display pixels of the PDP upon power-up of the apparatus. Specifically, as shown in FIG. 4, during the period of the charge driving sequence, the address driver 2 charges the capacitor C3 to half the potential of the power source B7, that is, $V_d/2$, and the X row electrode driver 3 and the Y row electrode driver 4 respectively charge the capacitors C1 and C2 to half the potentials of the power sources B1 and B3, that is, $V_{s1}/2$.

According to the PDP driving apparatus of the present invention, after the PDP driving apparatus performs the charge driving sequence, it shifts to the aforementioned normal display driving sequence composed of the reset period, address period, and sustain period.

Figure 5:
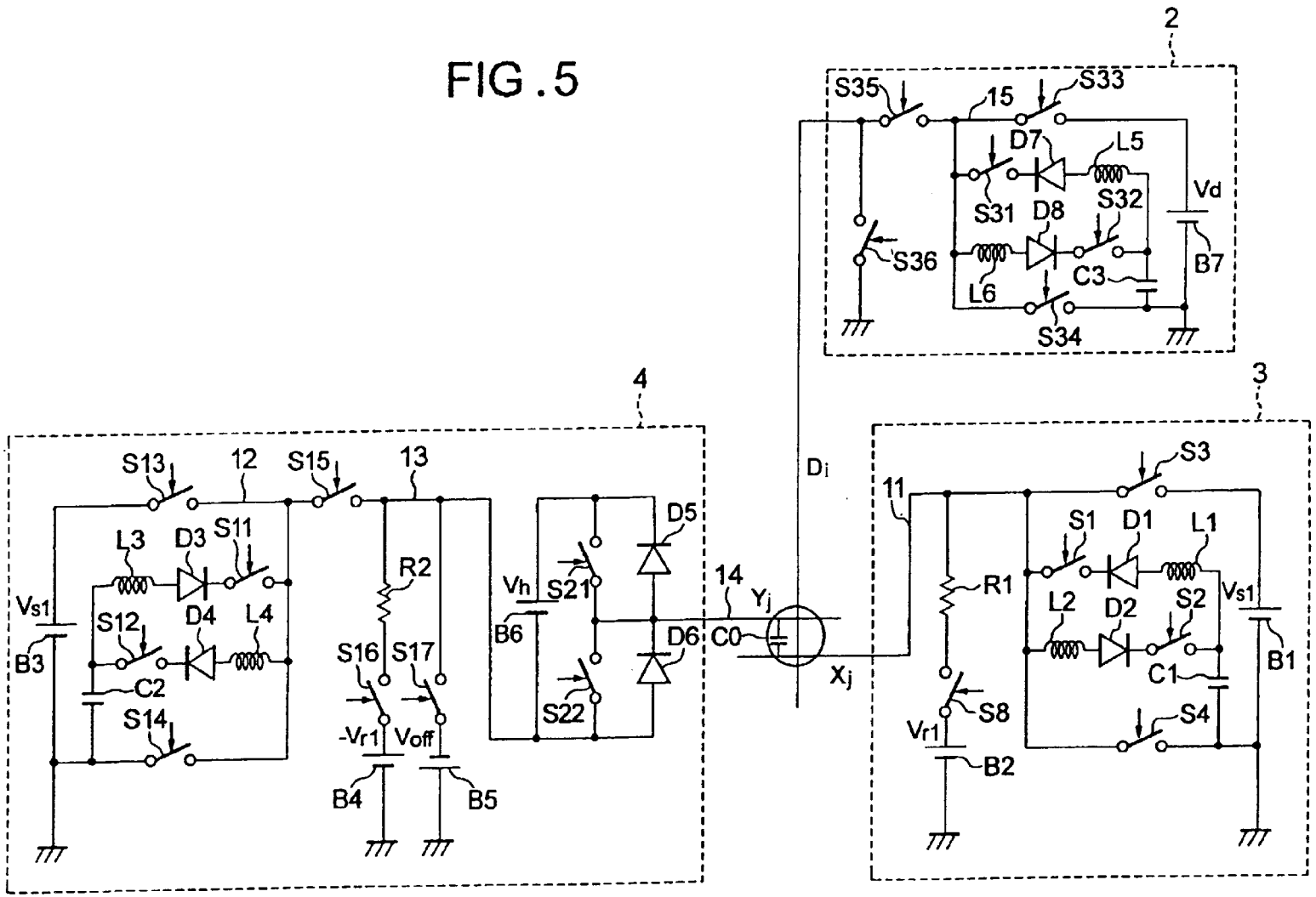
FIG. 5 is a circuit diagram showing an embodiment of a PDP driving circuit of the present invention.

FIG. 5 is a circuit diagram showing an arrangement of a driving circuit for one pixel in the PDP 1 of the PDP driving apparatus of the present invention. Like components are labeled with like reference numerals with respect to FIG. 2 for ease of explanation.

Figure 1:
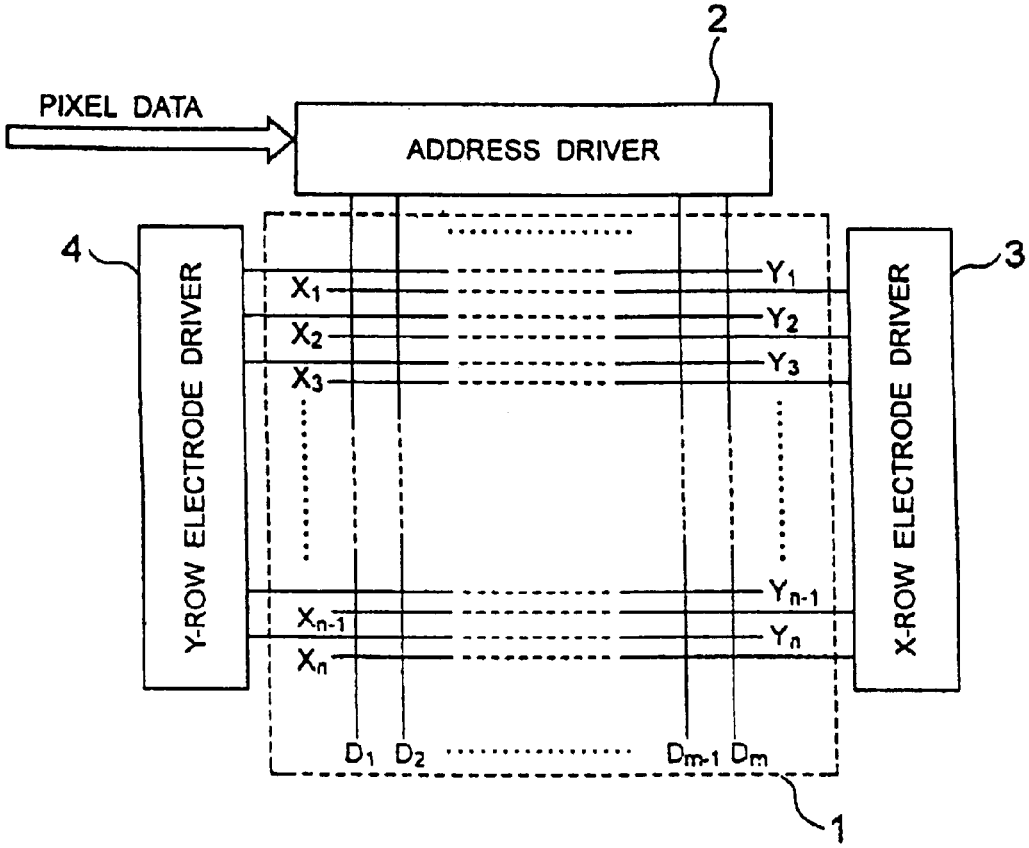
FIG. 1 Prior Art
FIG. 1 is a block diagram depicting an arrangement of a conventional PDP driving apparatus.
Figure 2:
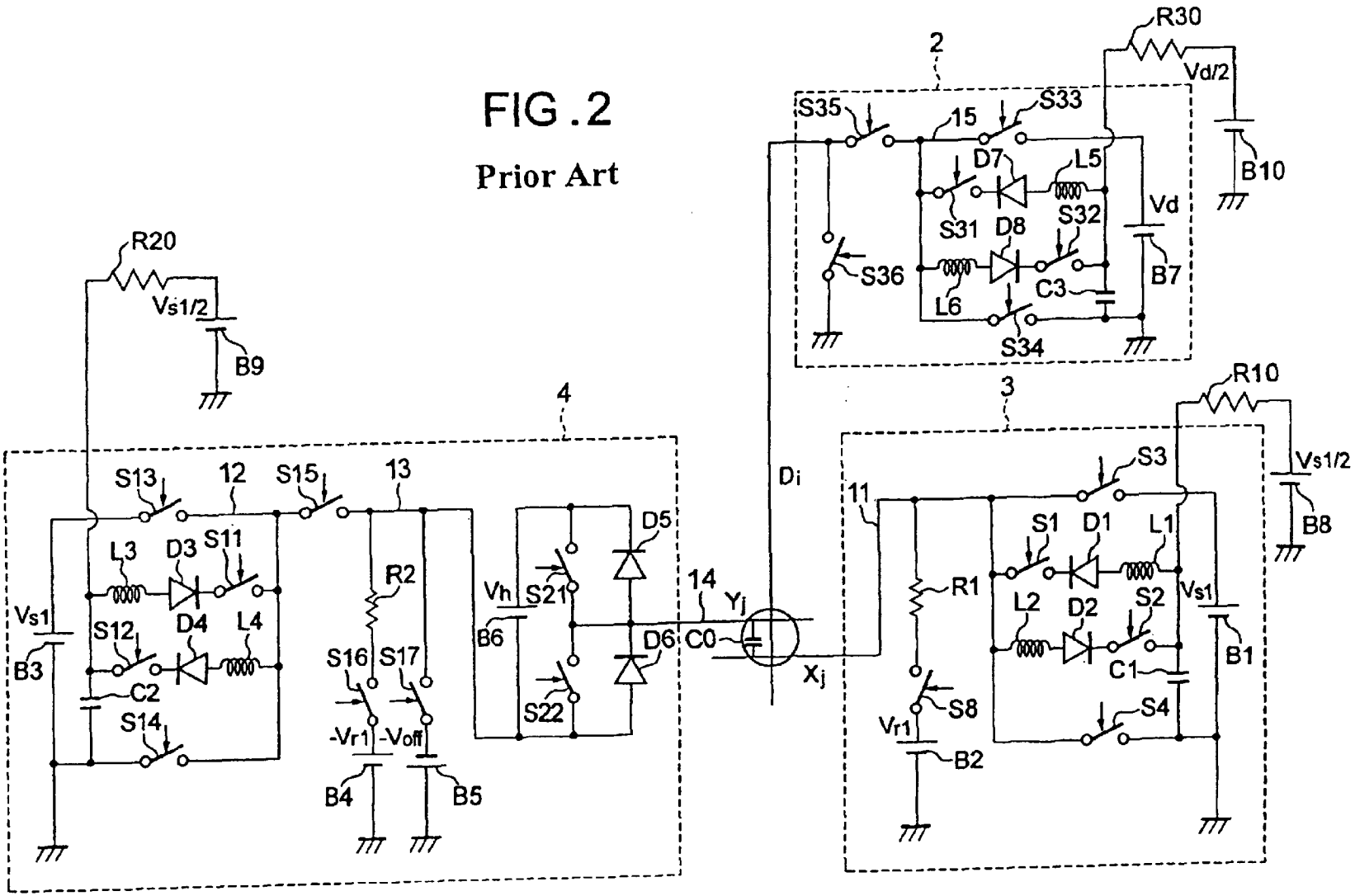
FIG. 2 Prior Art
FIG. 2 is a circuit diagram depicting an arrangement of one pixel in the conventional PDP driving apparatus.
Figure 3:
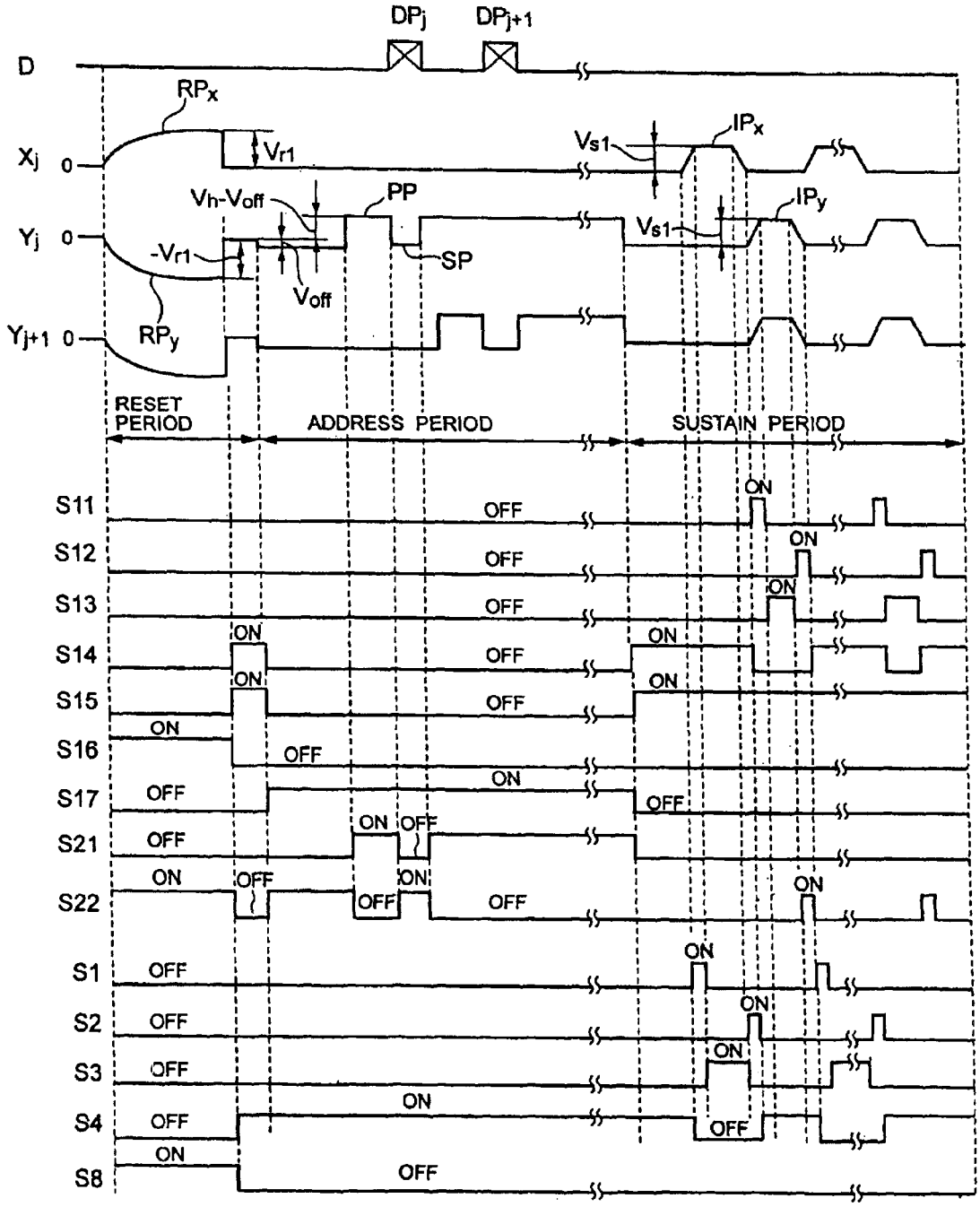
FIG. 3 Prior Art
FIG. 3 is a time chart for each portion in the circuitry shown in FIG. 2.

The circuitry shown in FIG. 5 omits the charge circuits (power sources B8 through B10 and the resistors R10, R20, and R30) for the power collecting capacitors (C1 through C3) in their respective resonance drivers activated upon power-up from the circuit arrangement shown in FIG. 2, and because the other arrangements are the same, an explanation of each portion in the circuit is omitted.

Figure 6:
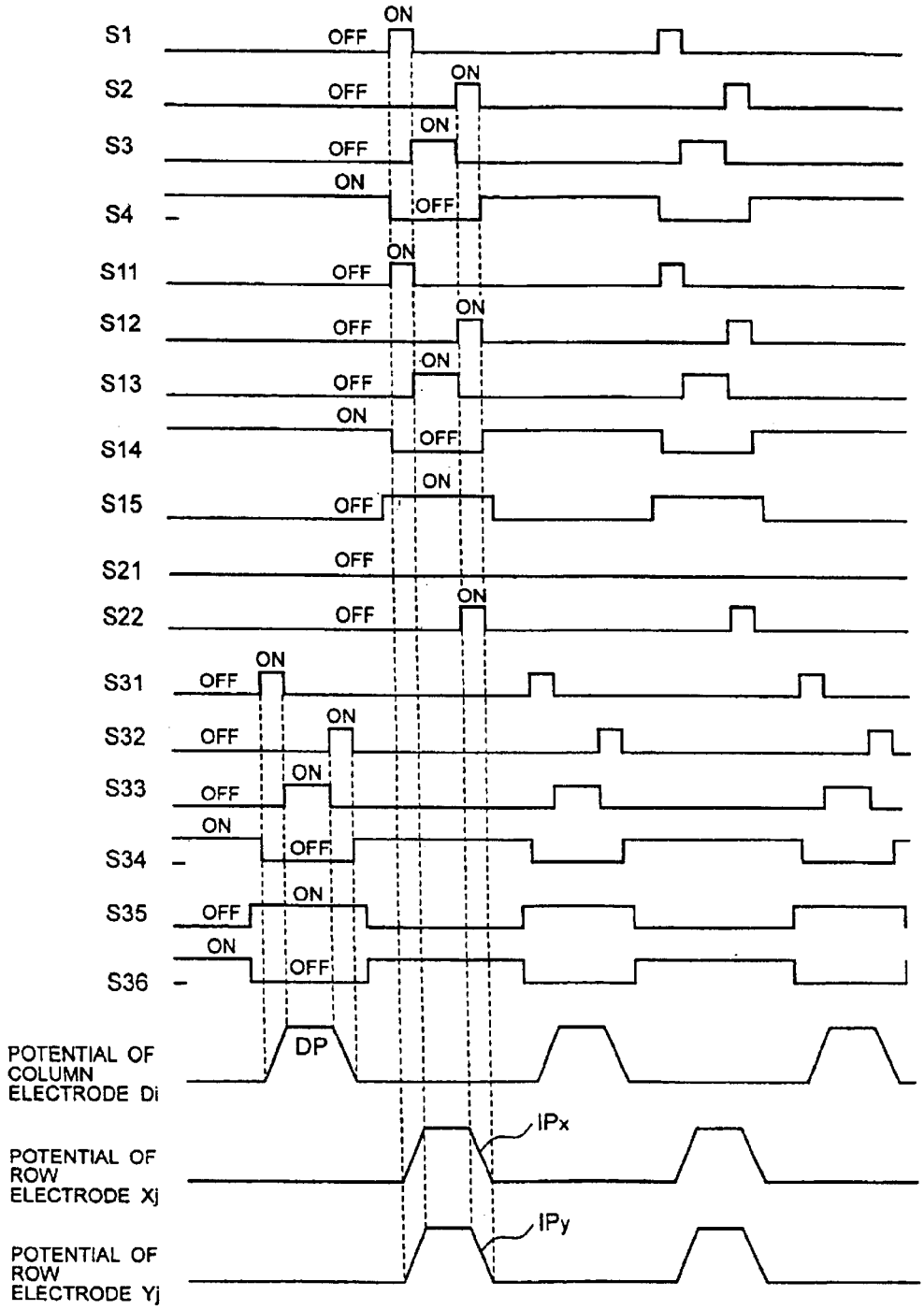
FIG. 6 is a time chart in the charge driving sequence for each portion in the circuitry shown in FIG. 5.

The following description will describe an operation of the circuitry of FIG. 5 in the charge driving sequence with reference to the time chart of FIG. 6.

In the charge driving sequence, the column electrode circuit is excited by applying a charge driving pulse to the column electrode $D_i$ in the first place, which will be described more in detail in the following.

Initially, in the address driver 2 of FIG. 5, the switching element S36 is switched OFF, and the switching element S35 is switched ON. Consequently, the condition is prepared for applying a charge driving pulse to the column electrode $D_i$ from the address driver 2.

Then, the switching element S34 is switched OFF and the switching element S31 is switched ON, whereupon a current reaches the electrode $D_i$ through the coil L5, the diode D7 and the switching element S31 due to the charges accumulated in the capacitor C3, and the current flows into a capacitive load formed between the column electrode $D_i$ and the corresponding discharge cell, whereby the capacitive load is charged. At this point, as shown in FIG. 6, the potential of the electrode Di increases gradually because of a time constant of the coil L5 and the capacitive load.

Subsequently, the switching element S31 is switched OFF and the switching element S33 is switched ON. Consequently, the potential $V_d$ at the positive terminal of the power source B7 is applied to the electrode $D_i$. Subsequently, the switching element S33 is switched OFF and the switching element S32 is switched ON, whereupon a current flows into the capacitor C3 from the electrode $D_i$ through the coil L6, the diode D8, and the switching element S32 due to the charges accumulated in the capacitive load between the column electrode $D_i$ and the discharge cell.

At this point, as shown in FIG. 6, the potential of the electrode $D_i$ decreases gradually because of a time constant of the coil L6 and the capacitor C3. When the potential of the electrode $D_i$ decreases to almost 0 V, the switching element S32 is switched OFF and the switching element S34 is switched ON, whereupon the capacitive load between the column electrode $D_i$ and the discharge cell is grounded.

According to a series of these operations, the address driver 2 applies a charge driving pulse Dp of a positive voltage as shown in FIG. 6 to the electrode $D_i$.

The charges accumulated in the capacitor C3 immediately after the power-up of the apparatus are 0 or have an extremely slight quantity, so that an increase in the potential of the charge driving pulse Dp is an extremely small value. However, the amplitude of the charge driving pulse applied to the electrode $D_i$ with a power supply from the power source B7 increases abruptly while the excitation driving is repeated, and accordingly, so does the charge potential of the capacitor C3.

After the switching element S34 is switched ON and the potential of the column electrode $D_i$ decreases to almost 0, the switching element S35 is switched OFF and the switching element S36 is switched ON, whereupon the address driver 2 is disconnected from the electrode $D_i$.

On the other hand, in the X row electrode driver 3, the switching element S4 stays ON and the potential of the electrode $X_j$ is the ground potential at almost 0 V. However, when the charge driving pulse Dp from the address driver 2 is lost, the switching element S4 is switched OFF and the switching element S1 is switched ON. Consequently, a current reaches the electrode $X_j$ through the coil L1, the diode D1, and the switching element S1 due to the charges accumulated in the capacitor C1, and the current flows into the capacitor C0 in the discharge cell, whereby the capacitor C0 is charged. At this point, as shown in FIG. 6, the potential of the electrode $X_j$ increases gradually because of a time constant of the coil L1 and the capacitor C0.

Then, the switching element S1 is switched OFF and the switching element S3 is switched ON. Consequently, the potential $V_{s1}$ at the positive terminal of the power source B1 is applied to the electrode $X_j$. Subsequently, the switching element S3 is switched OFF and the switching element S2 is switched ON, whereupon a current flows into the capacitor C1 from the electrode $X_j$ through the coil L2, the diode D2, and the switching element S2 due to the charges accumulated in the capacitor C0.

At this point, as shown in FIG. 6, the potential of the electrode $X_j$ decreases gradually because of a time constant of the coil L2 and the capacitor C1. When the potential of the electrode $X_j$ decreases to almost 0 V, the switching element S2 is switched OFF and the switching element S4 is switched ON, whereupon the capacitor C0 is grounded.

According to a series of these operations, the X row electrode driver 3 applies a charge driving pulse $IP_x$ of a positive voltage as shown in FIG. 6 to the electrode $X_j$.

Also, in the Y row electrode driver 4, when the charge driving pulse Dp in the column electrode $D_i$ is lost, the switching element S14 is switched OFF at the same time the switching element S4 in the X row electrode driver 3 is switched OFF. Then, the switching element S11 is switched ON in synchronism with the switching ON of the switching element S1 in the X row electrode driver 3. The potential of the electrode $Y_j$ is the ground potential at almost 0 V while the switching element S14 stays ON. However, when the switching element S14 is switched OFF and the switching element S11 is switched ON, a current reaches the electrode $Y_j$ through the coil L3, the diode D3, the switching element S11, the switching element S15, and the diode D6 due to the charges accumulated in the capacitor C2, and the current flows into the capacitor C0, whereby the capacitor C0 is charged. At this point, as shown in FIG. 6, the potential of the electrode $Y_j$ increases gradually because of a time constant of the coil L3 and the capacitor C0.

Then, the switching element S11 is switched OFF and the switching element S13 is switched ON in synchronism with the movements of the switching elements S1 and S3 in the X row electrode driver 3. Consequently, the potential $V_{s1}$ at the positive terminal of the power source B3 is applied to the electrode $Y_j$ through the switching element S13, the switching element S15, and the diode D6.

Subsequently, the switching element S13 is switched OFF and the switching element S12 is switched ON, and further, the switching element S22 is switched ON in synchronism with the movements of the switching elements S3 and S2 in the X row electrode driver 3. Consequently, a current flows into the capacitor C2 from the electrode $Y_j$ through the switching element S22, the switching element S15, the coil L4, the diode D4, and the switching element S12 due to the charges accumulated in the capacitor C0. At this point, as shown in FIG. 6, the potential of the electrode $Y_j$ decreases gradually because of a time constant of the coil L4 and the capacitor C2. When the potential of the electrode $Y_j$ decreases to almost 0 V, the switching elements S12 and S22 are switched OFF and the switching element S14 is switched ON.

According to a series of these operations, the Y row electrode driver 4 applies a charge driving pulse $IP_y$ of a positive voltage as shown in FIG. 6 to the electrode $Y_j$.

As is obvious from the above description and the time chart of FIG. 6, the charge driving pulses $IP_x$ and $IP_y$ respectively applied to the electrode $X_j$ and the electrode $Y_j$ have pulse waveforms in synchronism with each other over time. In other words, the charge driving pulses $IP_x$ and $IP_y$ respectively applied to the electrode $X_j$ and the electrode $Y_j$ of the capacitor C0 are in-phase pulses of the same polarity, and therefore, a potential difference between the electrode $X_j$ and the electrode $Y_j$ does not vary. Hence, no discharge occurs between the electrode $X_j$ and the electrode $Y_j$ of the capacitor C0 during the charge driving sequence, and naturally, no light is emitted erroneously in the discharge cell of the capacitor C0.

The charges accumulated in the capacitors C1 and C2 immediately after the power-up of the apparatus are 0 or have an extremely slight quantity, so that an increase in the potential of the charge driving pulses $IP_x$ and $IP_y$ is an extremely small value. However, the amplitude of the charge driving pulses applied to the electrode $X_j$ and the electrode $Y_j$ with power supplies from the power sources B1 and B3 increases abruptly while the excitation driving is repeated, and accordingly, so does the charge potential of each of the capacitors C1 and C2.

As shown in the time chart of FIG. 6, the foregoing operations of the address driver 2, the X row electrode driver 3, and the Y row electrode driver 4 are repetitively performed during the charge driving sequence. When the charge potentials in all the power collecting capacitors C1 through C3 in their respective drivers increase to the midpoint potentials of their respective resonance voltages, a control circuit (not shown) in the PDP driving apparatus terminates the charge driving sequence, and shifts to the aforementioned normal display driving sequence.

Regarding the judgment as to whether the charge potentials in all the capacitors have reached the midpoint potentials of their respective resonance voltages, that is, the judgment as to whether the charge driving sequence is terminated or not, the control circuit may, for example, monitor the potential in each capacitor directly with a high impedance potential sensor. Alternatively, because a time constant during the charge and a duty cycle of the charge driving pulse are known, it is possible to pre-compute an increase in the potential by the excitation driving. Hence, the termination of the charge driving sequence may be judged by a predetermined timer the control circuit has set.

The embodiment described above shows a case where a resonance driver circuit is used for each of the column electrode driving circuit and the row electrode pair driving circuit in the PDP driving circuit. It should be appreciated, however, that the present invention is not limited to the foregoing. For example, the present invention is applicable to a case where a resonance driver circuit is used for the row electrode pair driving circuit alone.

In this case, in the charge driving sequence performed upon power-up of the apparatus, as has been described above, the charge driving pulses in-phase and of the same polarity are repetitively applied to the electrode X and the electrode Y in the row electrode pair for a certain period of time, so that the power collecting capacitive elements included in their respective resonance drivers, that is, the capacitors C1 and C2, are charged to the midpoint potential $V_{s1}/2$ between the high potential $V_{s1}$ and the low potential 0 during the resonance.

The present embodiment shows a case where a PDP is used as a display panel having a capacitive light emitting load. It should be appreciated, however, that the present invention is not limited to the foregoing. It is needless to say that the present invention can be applied to any display panel having a capacitive light emitting load, for example, an EL display apparatus.

As has been described, according to the present invention, it is possible to charge the power collecting capacitive element, which is included in the resonance driver in a light-emitting display panel driving apparatus having a capacitive load, to a predetermined potential almost concurrently with the power-up of the apparatus through excitation by the resonance driver. Hence, it is possible to drastically shorten a time required to display an image by shifting to the normal display driving sequence since the power-up of the driving apparatus.

In particular, in the matrix display type having row electrode pairs, the row electrode pairs in the driving apparatus are excited by the charge driving pulses in-phase and of the same polarity during the charge driving sequence by the resonant driver. Hence, hardly any light is emitted erroneously in the discharge cell during the charge driving sequence.

This application is based on Japanese Patent Application No. 2001-179900 which is herein incorporated by reference.

What is claimed is:

1. A driving apparatus of a display panel for driving said display panel, having a plurality of row electrode pairs and a plurality of column electrodes aligned to intersect with said row electrode pairs in forming a light emitting display cell at each intersection portion, including a plurality of driving circuits for selectively supplying light-emitting-display driving pulses to said row electrode pairs and said column electrodes through an output terminal, thereby performing light emission drive of said display panel, wherein:

each of said driving circuits has a switching resonance charge/discharge circuit for performing generation of said driving pulses, said switching resonance charge/discharge circuit including a switch circuit for forming a forward/reverse current path alternatively between said output terminal and a power collecting capacitive element through an inductance element; and said switch circuit performs a switching operation not only during a light emitting display operation, but also upon power-up, wherein, in a pair of first driving circuits among said plurality of driving circuits which are connected to each of said row electrode pairs, said switch circuit in each of said first driving circuits performs the switching operation in synchronism with each other upon power-up so that pulses of a same polarity are simultaneously supplied to said row electrode pairs, and said power collecting capacitive element in each of said first driving circuits is charged to a midpoint potential of a resonance voltage by said switching operation.

2. The driving apparatus of a display panel according to claim 1, wherein, in a second driving circuit among said plurality of driving circuits which is connected to said column electrodes, said switch circuit in said second driving circuit performs the switching operation alternately with the switching operation by said first driving circuits upon power-up; and said power collecting capacitive element in said second driving circuit is charged to the midpoint potential of the resonance voltage by said switching operation.

3. The driving apparatus of a display panel according to any one of claims 1 and 2, wherein said inductance element is composed of first and second inductance elements each connected to a different current path in said forward/reverse current path, and said switch circuit includes:

first potential transfer means for transferring a potential of an electrode connected to said driving circuit from a first potential to a second potential by resonance between said first inductance element and the capacitive load that said light emitting display cell has;

power supplying means for supplying power to said capacitive load;

second potential transfer means for transferring the potential of the electrode connected to said driving circuit from the second potential to the first potential by resonance between said second inductance element and the capacitive load; and power collecting means for collecting power from said capacitive load to said power collecting capacitive element.

4. A driving apparatus of a display panel including a display panel provided with a plurality of light emitting display cells each having a capacitive load, and a light emitting driving circuit for selecting said light emitting display cells and supplying a light emitting driving pulse to said selected cells through output terminals, wherein:

said light emitting driving circuit has switching resonance charge/discharge circuits for respectively performing generation of said light emitting driving pulses, each of said resonance charge/discharge circuits including a switch circuit for forming a forward/reverse current path alternatively between said output terminal and a power collecting capacitive element through an inductance element; and said switch circuit performs a switching operation not only during a light emitting display operation, but also upon power-up, wherein said switch circuit of each of said resonance charge/discharge circuits performs the switching operation in synchronism with each other upon power-up so that pulses of a same polarity are simultaneously supplied to electrode pairs provided in each of said display cells, and said power collecting capacitive element is charged to a midpoint potential of a resonance voltage by said switching operation.

5. A driving apparatus of a display panel for driving said display panel, having a plurality of row electrode pairs and a plurality of column electrodes aligned to intersect with said row electrode pairs in forming a light emitting display cell at each intersection portion, including a plurality of driving circuits for selectively supplying light-emitting-display driving pulses to said row electrode pairs and said column electrodes through an output terminal, thereby performing light emission drive of said display panel, wherein:

said plurality of driving circuits include a pair of first driving circuits respectively connected to said row electrode pairs, each of said first driving circuits having a switching resonance charge/discharge circuit for performing generation of said driving pulses, which includes a switch circuit for forming a forward/reverse current path alternatively between said output terminal and a power collecting capacitive element through an inductance element, and said switch circuit performs a switching operation not only during a light emitting display operation, but also upon power-up, and wherein, in the pair of first driving circuits, said switch circuit in each of said first driving circuits performs the switching operation in synchronism with each other upon power-up so that pulses of a same polarity are simultaneously supplied to said row electrode pairs, and said power collecting capacitive element in each of said first driving circuits is charged to a midpoint potential of a resonance voltage by said switching operation.

* * * * *